US006027391A

United States Patent [19]

DeRennaux

[11] Patent Number: 6,027,391

[45] Date of Patent: Feb. 22, 2000

[54] CD ROM MODEL KIT AND METHOD OF USE

[76] Inventor: Rick DeRennaux, P.O. Box 13, Bland, Mo. 65014

[21] Appl. No.: 08/979,716

[22] Filed: Nov. 28, 1997

[51] Int. Cl.[7] ..... A63H 27/16; A63H 33/16

[52] U.S. Cl. ..... 446/67; 446/61; 446/62; 446/488

[58] Field of Search ..... 446/88, 488; 434/365, 434/372, 373

[56] References Cited

U.S. PATENT DOCUMENTS

| | | | |
|---|---|---|---|
| 4,003,155 | 1/1977 | Raskin | 446/67 |
| 4,270,301 | 6/1981 | Meek | 446/88 |
| 5,398,893 | 3/1995 | Barker | 244/215 |
| 5,445,591 | 8/1995 | Fougere | 493/439 |
| 5,676,580 | 10/1997 | Farrar | 446/34 |
| 5,786,864 | 7/1998 | Yamamoto | 348/473 |

*Primary Examiner*—Robert A. Hafer
*Assistant Examiner*—Kurt Fernstrom

[57] ABSTRACT

A kit for assisting in the fabrication of a model is disclosed. Such kit includes a compact disk positionable within the computer for being read and for the issuing of commands to the printer in response to input from a user. The compact disk includes a plurality of separate and distinct programs, each program representing a particular model to be fabricated. Each program includes instruction data adapted to be printed out by the printer and read by a user. Each program further includes template data adapted to be printed out and used by a user in the fabricating of a model. The instructions and templates correspond to the program selected by a user. The templates are adapted to be printed out by the printer and cut by the user in accordance with the printed out instructions in a correlated manner in response to commands from the computer and input from the user from any particular program on the compact disk.

18 Claims, 5 Drawing Sheets

30
10
20
22
16
28
26

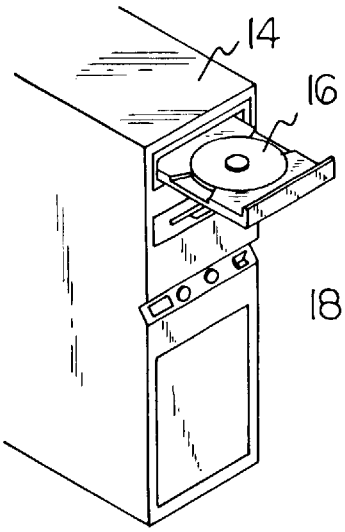
Fig. 2
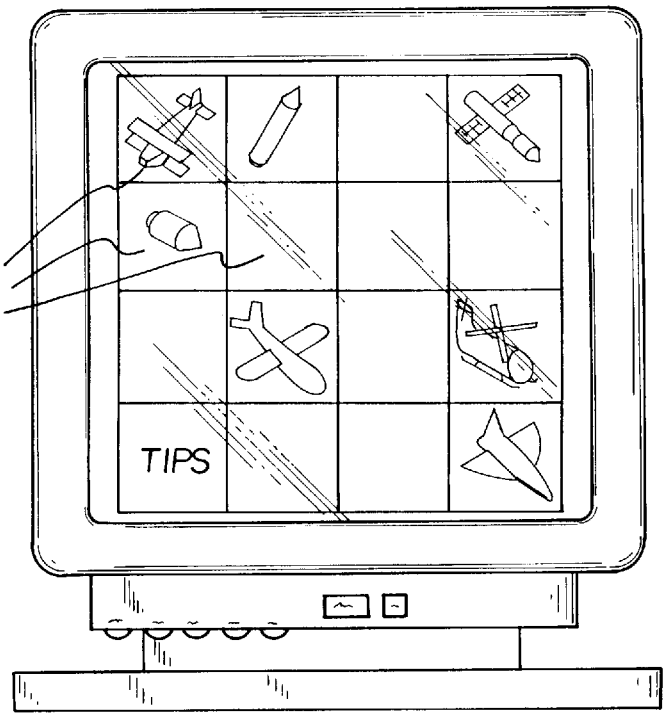
Fig. 3
Fig. 4
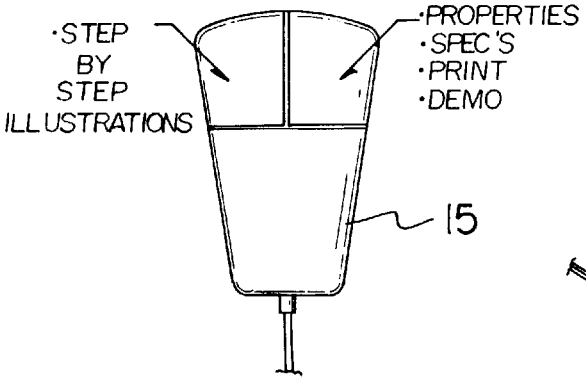
Fig. 5
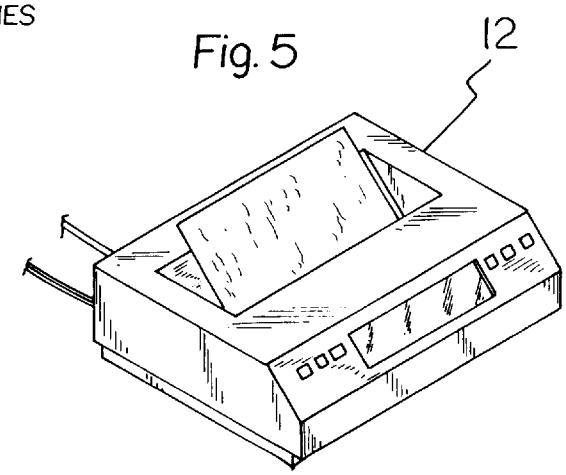

FIG 8
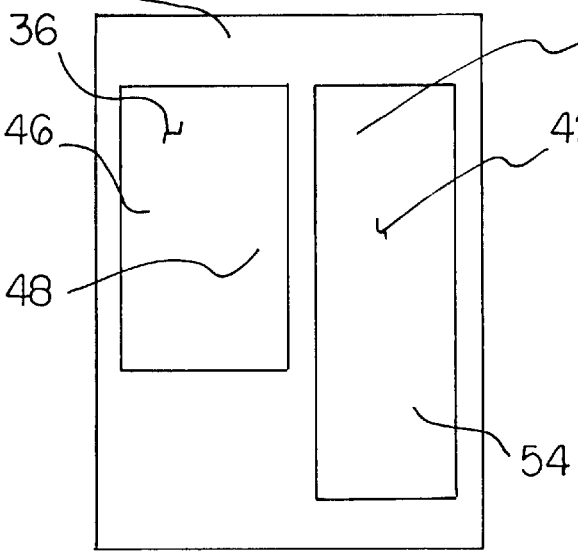
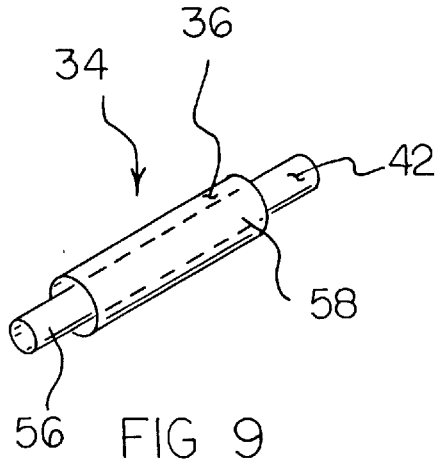
FIG 9
FIG 10
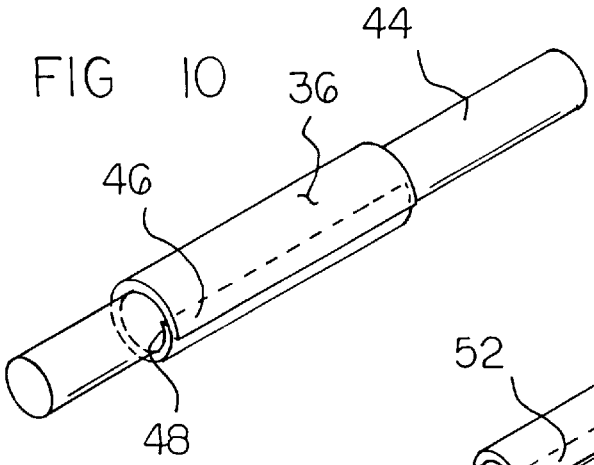
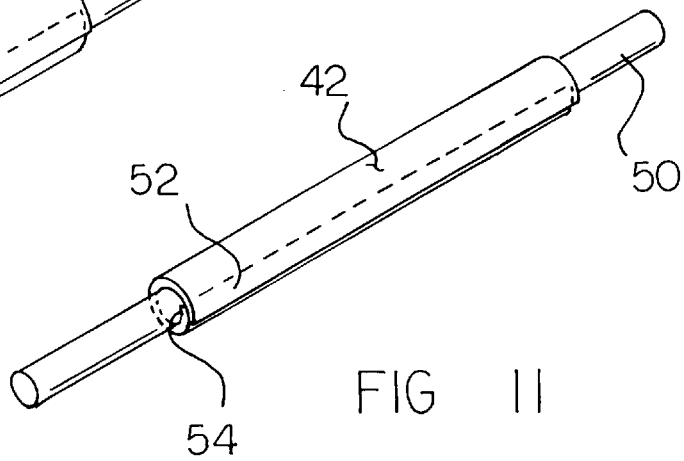
FIG 11

FIG 12
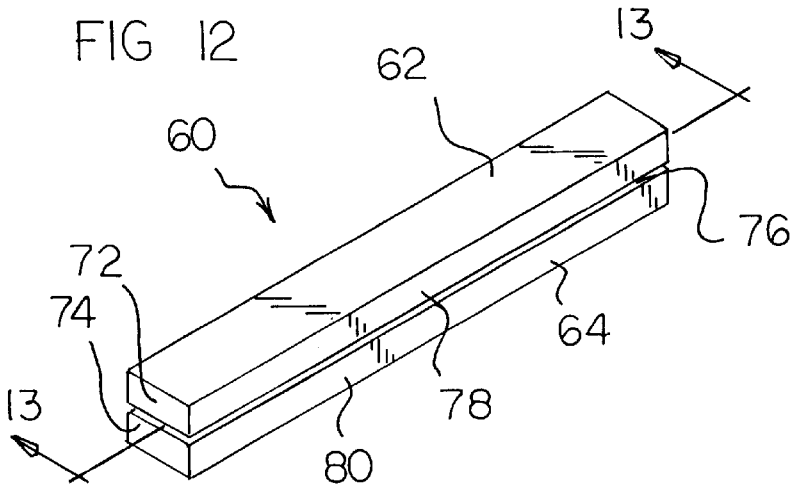
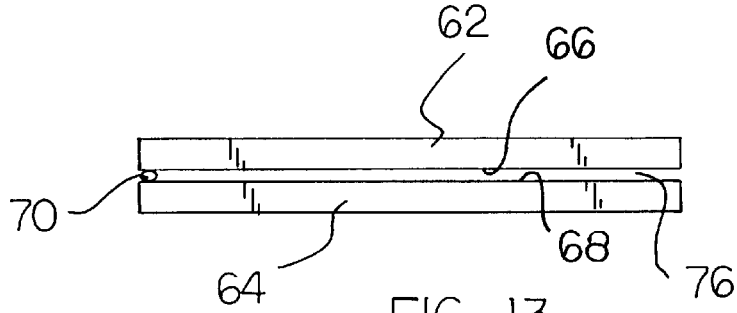
FIG 13
FIG 14
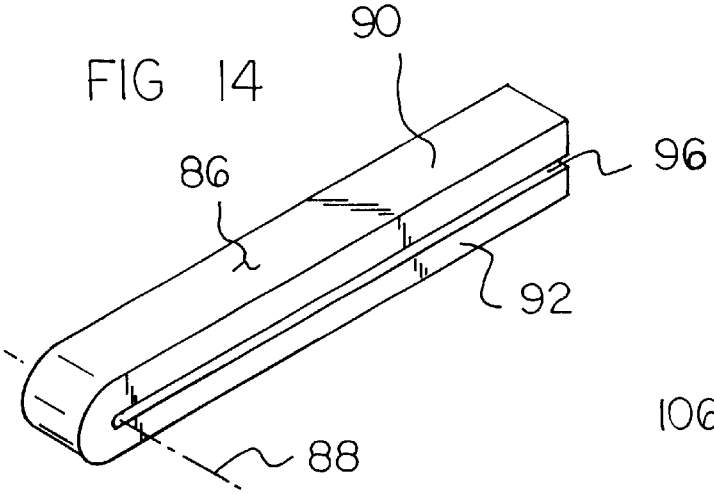
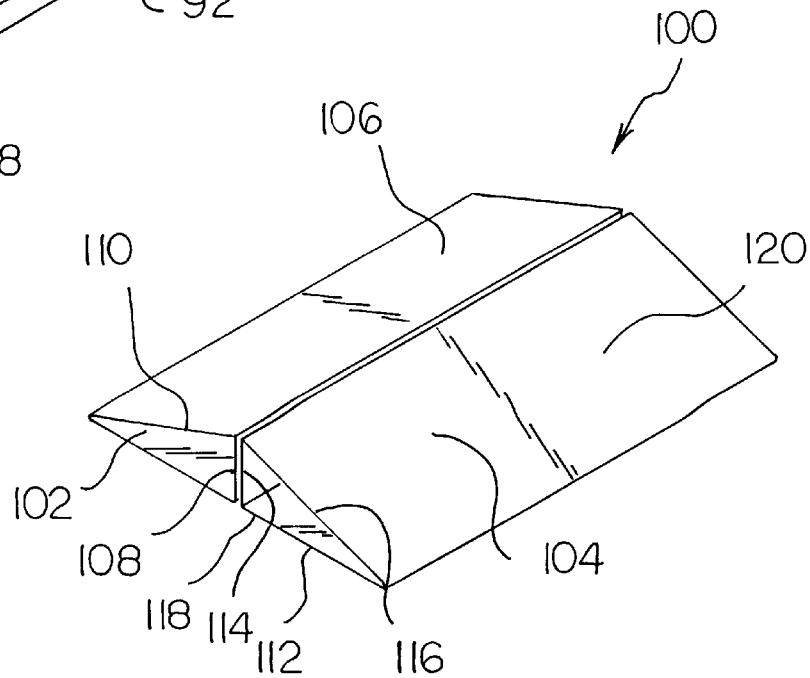
FIG 15

CD ROM MODEL KIT AND METHOD OF USE

BACKGROUND OF THE INVENTION

1. Field of the Invention

The present invention relates to a new and improved CD ROM model kit and method of use and, more particularly, pertains to the fabrication of toy model aircraft and the like through the use of a computer and associated CD ROM.

2. Description of the Prior Art

The use of computers, CD ROMS, model airplane kits and model airplanes of various designs and configurations is known in the prior art. More specifically, the use of computers and CD ROMS heretofore devised and utilized for the purpose of utilizing data to produce patterns for the construction of three-dimensional objects through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of methods and apparatuses utilizing data to produce patterns for various fabrications. By way of example, U.S. Pat. No. 4,266,366 to Lapierre, issued May 12, 1981, discloses a prefabricated airplane model kit.

U.S. Pat. No. 4,327,615 to Gerber et al., issued May 4, 1982, discloses a method and apparatus for cutting sheet material with preprocessed data.

U.S. Pat. No. 4,551,810 to Levine, issued Nov. 5, 1985, discloses a method and apparatus for designing duct work and for producing patterns for conduit sections in the designed duct work.

U.S. Pat. No. 5,341,305 to Clarino et al., issued Aug. 23, 1994, discloses a computerized pattern development system capable of direct designer input.

U.S. Pat. No. 5,513,991 to Reynolds et al., issued May 7, 1996, discloses a method of simulating personal individual art instruction.

Lastly, U.S. Pat. No. 5,559,709 to Ohno et al., issued Sep. 24, 1996, discloses a pattern making and pattern drafting system.

In this respect, the CD ROM model kit and method of use according to the present invention substantially departs from the conventional concepts and designs of the prior art, and in doing so provides an apparatus primarily developed for the purpose of the fabrication of toy model aircraft and the like through the use of a computer and associated CD ROM.

Therefore, it can be appreciated that there exists a continuing need for a new and improved CD ROM model kit and method of use which can be used for the fabrication of toy model aircraft and the like through the use of a computer and associated CD ROM. In this regard, the present invention substantially fulfills this need.

SUMMARY OF THE INVENTION

In view of the foregoing disadvantages inherent in the known types of model airplane kits and model airplanes and the like now present in the prior art, the present invention provides a new and improved CD ROM model kit and method of use. As such, the general purpose of the present invention, which will be described subsequently in greater detail, is to provide a new and improved CD ROM model kit and method of use which has all the advantages of the prior art and none of the disadvantages.

To attain this, the present invention essentially comprises a new and improved kit for assisting in the fabrication of toy model aircraft and the like for use with a printer adapted to print output in response to commands from a computer; a computer adapted to read information from a compact disk and to command a printer to print output from computer commands in response to input from a user comprising, in combination a compact disk positionable within the computer for being read and for the issuing of commands to the printer in response to input from a user, the compact disk including a plurality of separate and distinct programs, each program representing a particular model aircraft to be fabricated, each program including instruction data adapted to be printed out by the printer and read by a user, and each program also including template data adapted to be printed out and utilized by a user in the fabricating of model aircraft, the instructions and templates corresponding to the program selected by a user, the templates adapted to be printed out by the printer and cut by the user in accordance with the printed out instructions in a correlated manner in response to commands from the computer and input from the user from any particular program on the compact disk; and supplemental components to assist in the fabrication of model aircraft including a bending tool, a quantity of paper sheets to be fed through the printer to have printed thereon instructions and templates for use by the user, a plurality of paper clips for applying adhesive to templates, a plurality of long cylindrical rods for use in association with the fabrication of a model aircraft from the printed templates in accordance with the printed instructions and a bending rod for forming components of the model.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved CD ROM model kit and method of use which has all the advantages of the prior art methods for fabricating model aircraft and the like and none of the disadvantages.

It is another object of the present invention to provide a new and improved CD ROM model kit and method of use which may be easily and efficiently manufactured and marketed.

It is a further object of the present invention to provide a new and improved CD ROM model kit and method of use which is of a durable and reliable construction.

An even further object of the present invention is to provide a new and improved CD ROM model kit and method of use which is susceptible of a low cost of manufacture with regard to both materials and labor, and which accordingly is then susceptible of low prices of sale to the consuming public, thereby making such a CD ROM model kit and method of use economically available to the buying public.

Even still another object of the present invention is to fabricate toy model aircraft and the like through the use of a computer and associated CD ROM.

Lastly, it is an object of the present invention to provide a kit for assisting in the fabrication of a model. Such kit includes a compact disk positionable within the computer for being read and for the issuing of commands to the printer in response to input from a user. The compact disk includes a plurality of separate and distinct programs, each program representing a particular model to be fabricated. Each program includes instruction data adapted to be printed out by the printer and read by a user. Each program further includes template data adapted to be printed out and used by a user in the fabricating of a model. The instructions and templates correspond to the program selected by a user. The templates are adapted to be printed out by the printer and cut by the user in accordance with the printed out instructions in a correlated manner in response to commands from the computer and input from the user from any particular program on the compact disk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective illustration of a computer containing the compact disk of FIG. 1.

FIG. 3 is a front elevational view of the screen of the computer shown in FIG. 2 illustrating the various programs which may be selected for fabricating a particular model from a particular program.

FIG. 4 is a mouse adapted to be used in association with the computer of FIG. 2 and screen of FIG. 3 in the selection of the appropriate program for the particular model.

FIG. 5 is a printer adapted to be used in association with the computer of FIG. 2 for generating instructions and templates to be used for fabricating toy model aircraft and the like.

FIG. 8 is a plan view of an axle and bushing assembly template which may comprise the present invention.

FIG. 9 is a perspective view of an axle and bushing assembly which may comprise the present invention.

FIG. 10 is a perspective view showing the formation of the bushing which may comprise the present invention.

FIG. 11 is a perspective view showing the formation of the axle which may comprise the present invention.

FIG. 12 is a perspective view of a bending tool which may comprise the present invention.

FIG. 13 is a cross-sectional view of the bending tool taken along line 13—13 of FIG. 12.

FIG. 14 is a perspective view of an alternate embodiment of the bending tool comprising the present invention.

FIG. 15 is a perspective view of an airfoil built in accordance with a selected program comprising the invention.

The same reference numerals refer to the same parts throughout the various Figures.

DESCRIPTION OF THE PREFERRED EMBODIMENT

Figure 1:
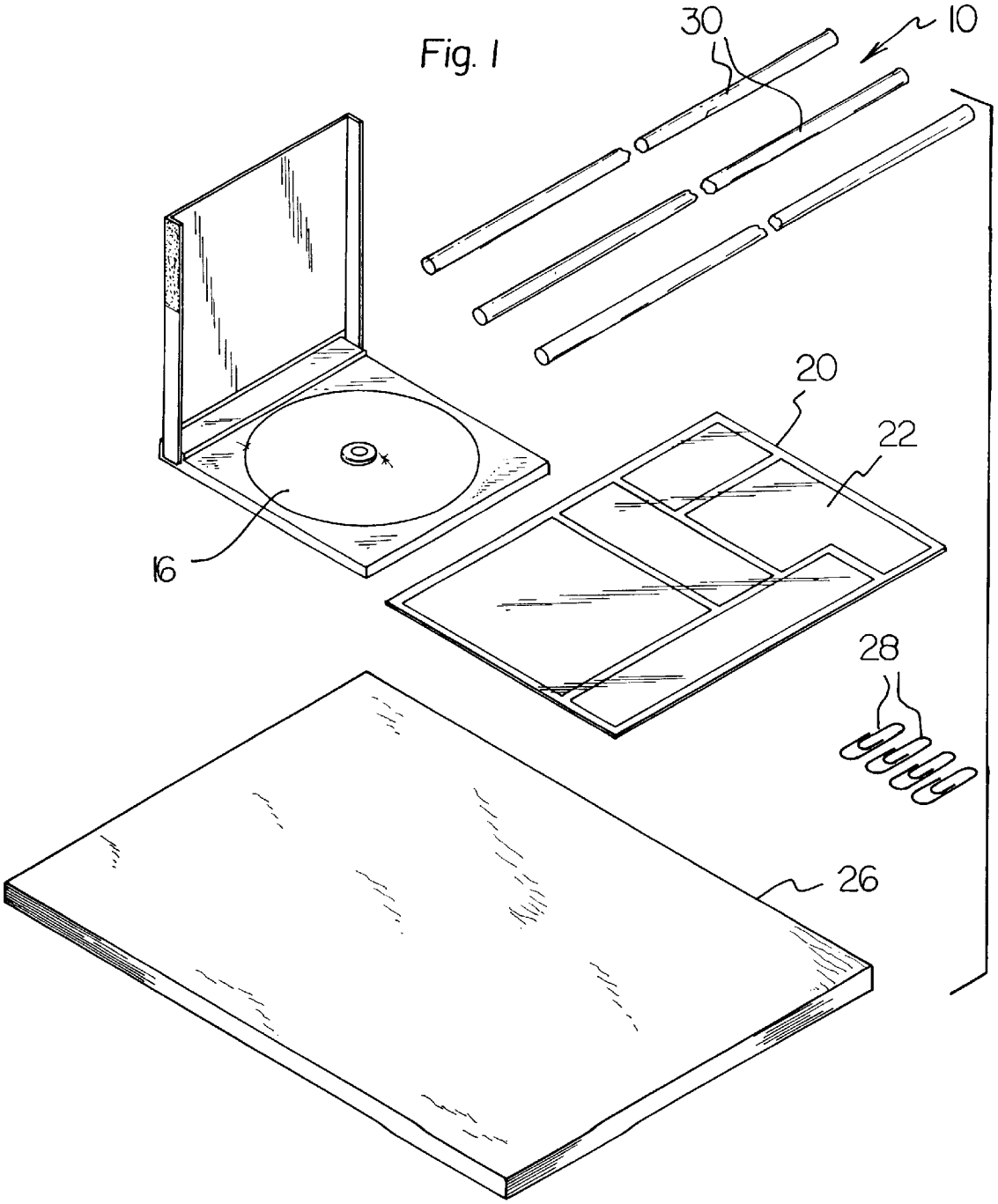
FIG. 1 is a perspective view of a portion of the CD ROM model kit fabricated in accordance with the principles of the present invention.
Figure 6:
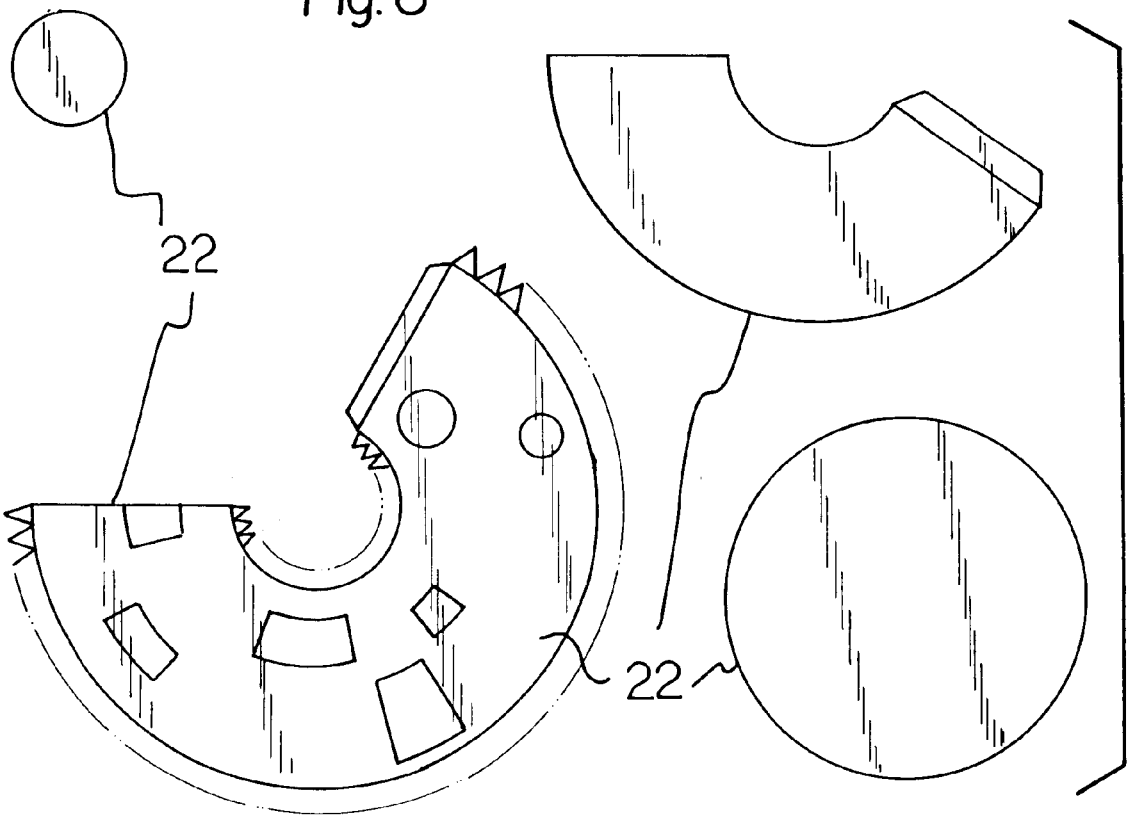
FIG. 6 is a front elevational view of portions of a template cut for use in association with the fabrication of a toy model aircraft in accordance with a selected program.
Figure 7:
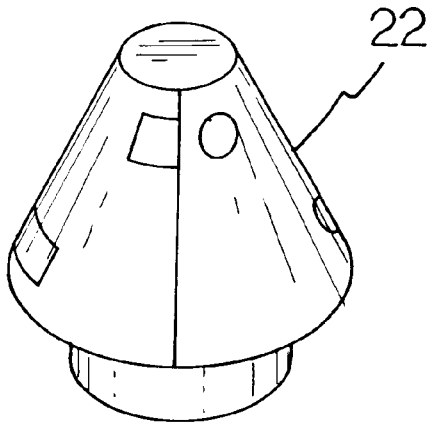
FIG. 7 is a perspective view of a toy model aircraft fabricated through the manipulation of the template components shown in FIG. 6.

With reference now to the drawings, and in particular to FIGS. 1 through 15 thereof, the preferred embodiment of the new and improved CD ROM model kit and method of use embodying the principles and concepts of the present invention and generally designated by the reference numeral 10 will be described.

The present invention is a kit 10. The kit may be used with a printer 12. The printer is adapted to print output in response to commands from a computer 14. The computer 14, which may also be used with the kit, is adapted to read information from a compact disk 16. In response thereto, the computer will command the printer to print output from the computer commands in response to input from a user as from a mouse 15.

The compact disk 16 is positionable within the computer. The compact disk is adapted to be read by the computer 14 for the issuing of commands to the printer 12. Such issuing of commands is in response to input from a user at the computer.

The compact disk 16 includes a plurality of separate and distinct programs 18. Each program represents a particular toy model aircraft or the like to be fabricated. Each program includes instruction data 20 which is adapted to be printed out by the printer and read by a user. Each program also includes template data 22 adapted to be printed out and used by a user in the fabrication of a toy model aircraft or the like. The instructions and templates correspond to the program selected by the user. The templates are adapted to be printed out by the printer and cut and bent by the user in accordance with the printed instructions. This is done in a correlated manner in response to commands from the computer and input from the user and relates to any particular program on the computer disk.

The templates may include an axle and bushing assembly 34. The assembly includes a first larger rectangular sheet 36 of paper included within a template 40 and a second smaller rectangular sheet 42 of paper included within the template. The first larger sheet is rolled around a large wooden dowel 44 and glued along overlapping opposing edges 46 and 48 thereby forming a large tube 58 for use as a bushing housing. Further, the smaller sheet is rolled around a small wooden dowel 50 having a diameter less than the diameter of the large wooden dowel. The overlapping opposing edges 52 and 54 of the smaller sheet are glued to one another thereby forming a small tube 56 positioned within the large tube thereby forming the axle and bushing assembly whereby the small tube rotates within the large tube.

Next included as part of the kit are supplemental components. Such supplemental components function to assist the user in the fabrication of a toy model aircraft or the like. The supplemental components include, at a minimum, a quantity of paper sheets 26. Such sheets are adapted to be fed through the printer to have printed thereon both the instructions and the templates for use by the user. Also part of the kit are a plurality of paper clips 28. Such paper clips are applying adhesive to the templates. Also a part of the supplemental components are a plurality of long cylindrical rods 30. Such rods are for use in association with the fabrication of a toy model aircraft from the printed templates in accordance with the printed instructions.

Finally, the kit includes a bending tool 60. The bending tool is formed of an assembly of two similar elongate flat members 62 and 64 having facing surfaces 66 and 68. The members are associated by a coupling means 70 at one end of the members positioned at and between corresponding short edges 72 and 74 of the members. A parting line 76 is formed between the members at elongate edges 78 and 80 thereof. In the preferred embodiment, the coupling means comprises an adhesive between the members at one end thereof, the adhesive is disposed such that the facing surfaces of the members are separable with respect to one another.

In an alternate embodiment, the bending tool is formed from a unitary, elongate piece of material 86. The elongate member is folded in half about an axis 88 transverse thereto thus forming two similar elongate flat legs 90 and 92 which extend from the fold. This arrangement provides a parting line 96 between the legs at elongate edges thereof.

In use, a medium, such as a sheet of paper of template, is placed between the flat members and the medium is bent at the parting line to form a crisp angle bend in the medium in response to a user sliding his finger over the edges of the members and medium at the parting line.

Further, the bending tool may be used to form an aircraft wing structure 100. The wing comprises a first wing tube member 102 having a right-triangular cross-section and a second wing tube member 104 also having a right-triangular cross-section arranged in a back to back configuration. The first wing tube has a base wall 106, an upstanding leg wall 108 and hypotenuse wall 110. Further, the second wing tube has a base wall 112 longer than the base wall of the first wing tube, an upstanding leg wall 114 substantially the same length as the first wing tube and hypotenuse wall 116 longer than the hypotenuse wall of the first wing tube. The wing tube members are adhered to each other at corresponding upstanding leg walls for forming an airfoil having a flat bottom surface 118 and an angular top surface 120.

Other supplemental components could be included as might be needed for a particular model. Consider, for example, glue, tape, paint, brushes and the like.

In the fabrication of model aircraft in accordance with the method above, there is included the steps of providing each of the components as outlined above. More particularly, the method steps include providing a printer, providing a computer, providing a compact disk, and providing supplemental components. Such printer, computer, compact disk and supplemental components are all as described above. The last step is thus the fabricating of a toy model aircraft or the like in response to the following of the above-listed method steps including the cutting and folding of the templates in accordance with the instructions and the adjoining together of the cut template portions, also in response to the instructions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved kit for assisting in the fabrication of toy model aircraft for use with a printer adapted to print output in response to commands from a computer and a computer adapted to read information from a compact disk and to command a printer to print output from computer commands in response to input from a user and the like comprising, in combination:

a compact disk positionable within the computer for being read and for the issuing of commands to the printer in response to input from a user, the compact disk including a plurality of separate and distinct programs, each program representing a particular model aircraft to be fabricated, each program including instruction data adapted to be printed out by the printer and read by a user, and each program also including template data adapted to be printed out and utilized by a user in the fabricating of model aircraft, the instructions and templates corresponding to the program selected by a user, the templates adapted to be printed out by the printer and cut by the user in accordance with the printed out instructions in a correlated manner in response to commands from the computer and input from the user from any particular program on the compact disk; and supplemental components to assist in the fabrication of model aircraft including a quantity of paper sheets to be fed through the printer to have printed thereon instructions and templates for use by the user, a bending tool for forming the templates, a plurality of paper clips for applying adhesive to the templates, and a plurality of long cylindrical rods for use in association with the fabrication of a model aircraft from the printed templates in accordance with the printed instructions.

2. The new and improved kit for assisting in the fabrication of toy model aircraft as set forth in claim 1 wherein the bending tool comprises two similar elongate flat members having facing surfaces, the members associated by a coupling means at one end of the members at corresponding short edges and forming a parting line between the members at elongate edges thereof.

3. The new and improved kit for assisting in the fabrication of toy model aircraft as set forth in claim 2 wherein the coupling means comprises an adhesive between the members at one end thereof, the adhesive disposed such that the facing surfaces of the members are separable with respect to one another.

4. The new and improved kit for assisting in the fabrication of toy model aircraft as set forth in claim 1 wherein the bending tool comprising an elongate member folded in half about an axis transverse thereto and forming two similar elongate flat legs extending from the fold thereby forming a parting line between the legs at elongate edges thereof.

5. The new and improved kit for assisting in the fabrication of toy model aircraft as set forth in claim 1 wherein the templates include an airfoil.

6. The new and improved kit for assisting in the fabrication of toy model aircraft as set forth in claim 5 wherein the airfoil comprises a first wing tube member having a right-triangular cross-section including an upstanding leg and a second wing tube member also having a right-triangular cross-section including an upstanding leg substantially the same length as the first wing tube upstanding leg, wherein the first wing tube member is arranged in a back to back configuration with the second wing tube member at the upstanding legs thereof.

7. A kit for assisting in the fabrication of a model comprising:

a compact disk positionable within the computer for being read and for the issuing of commands to the printer in response to input from a user, the compact disk including a plurality of separate and distinct programs, each program representing a particular model to be fabricated, each program including instruction data adapted to be printed out by the printer and read by a user, and each program also including template data adapted to be printed out and used by a user in the fabricating of a model, the instructions and templates corresponding to the program selected by a user, the templates adapted to be printed out by the printer and cut by the user in accordance with the printed out instructions in a correlated manner in response to commands from the computer and input from the user from any particular program on the compact disk.

8. The kit as set forth in claim 7 and further including a bending tool.

9. The kit as set forth in claim 8 wherein the bending tool comprises two similar elongate flat members having facing surfaces, the members associated by a coupling means at one end of the members at corresponding short edges and forming a parting line between the members at elongate edges thereof.

10. The kit as set forth in claim 9 wherein the coupling means comprises an adhesive between the members at one end thereof, the adhesive disposed such that the facing surfaces of the members are separable with respect to one another.

11. The kit as set forth in claim 8 wherein the bending tool comprising an elongate member folded in half about an axis transverse thereto and forming two similar elongate flat legs extending from the fold thereby forming a parting line between the legs at elongate edges thereof.

12. The kit as set forth in claim 7 and including:

supplemental components to assist in the fabrication of a model including a quantity of paper sheets to be fed through the printer to have printed thereon instructions and templates for use by the user, a plurality of paper clips for applying adhesive to the templates and a plurality of long cylindrical rods for use in association with the fabrication of a model aircraft from the printed templates in accordance with the printed instructions.

13. The kit as set forth in claim 7 wherein the templates include an airfoil.

14. The kit as set forth in claim 13 wherein the airfoil comprises a first wing tube member having a right-triangular cross-section including an upstanding leg and a second wing tube member also having a right-triangular cross-section including an upstanding leg substantially the same length as the first wing tube upstanding leg, wherein the first wing tube member is arranged in a back to back configuration with the second wing tube member at the upstanding legs thereof.

15. A method for the fabrication of toy models and the like for use with a printer adapted to print output in response to commands from a computer and a computer adapted to read information from a compact disk and to command a printer to print output from computer commands in response to input from a user, the method comprising:

providing a compact disk positionable within the computer for being read and for the issuing of commands to the printer in response to input from a user, the compact disk including a plurality of separate and distinct programs, each program representing a particular model to be fabricated, each program including instruction data adapted to be printed out by the printer and read by a user, and each program also including template data adapted to be printed out and utilized by a user in the fabricating of a model, the instructions and templates corresponding to the program selected by a user;

printing one of the templates adapted to be printed out by the printer;

cutting the templates by the user in accordance with the printed out instructions in a correlated manner in response to commands from the computer and input from the user from any particular program on the compact disk;

providing supplemental components to assist in the fabrication of models including a quantity of paper sheets to be fed through the printer to have printed thereon instructions and templates for use by the user, a bending tool for bending the templates, a plurality of paper clips for applying adhesive to the templates and a plurality of long cylindrical rods for use in association with the fabrication of a model from the printed templates in accordance with the printed instructions; and fabricating a model in response to the following of the above-listed method steps.

16. The method for the fabrication of toy models of claim 15 and the like and further including the step of:

placing a template in the bending tool and bending the template for forming a crisp angle bend in the template in response to a user sliding his finger over the bending tool.

17. The method for the fabrication of toy models and the like of claim 15 and further including:

forming an aircraft wing structure having a first wing tube member having a right-triangular cross-section and a second wing tube member also having a right-triangular cross-section arranged in a back to back configuration wherein the first wing tube has a base wall, an upstanding leg wall and hypotenuse wall and the second wing tube has a base wall longer than the base wall of the first wing tube, an upstanding leg wall substantially the same length as the first wing tube and hypotenuse wall longer than the hypotenuse wall of the first wing tube and the wing tube members are adhered to each other at corresponding upstanding leg walls for forming an airfoil having a flat bottom surface and an angular top surface.

18. A method for the fabrication of toy models and the like for use with a printer adapted to print output in response to commands from a computer and a computer adapted to read information from a compact disk and to command a printer to print output from computer commands in response to input from a user, the method comprising:

providing a compact disk positionable within the computer for being read and for the issuing of commands to the printer in response to input from a user, the compact disk including a plurality of separate and distinct programs, each program representing a particular model to be fabricated, each program including instruction data adapted to be printed out by the printer and read by a user, and each program also including template data adapted to be printed out and utilized by a user corresponding to the program selected by a user;

printing one of the templates adapted to be printed out by the printer;

cutting the templates by the user in accordance with the printed out instructions in a correlated manner in response to commands from the computer and input from the user from any particular program on the compact disk;

providing supplemental components to assist in the fabrication of models including a quantity of paper sheets to be fed through the printer to have printed thereon instructions and templates for use by the user, a bending tool for bending the templates, a plurality of paper clips for applying adhesive to the templates and a plurality of long cylindrical rods for use in association with the fabrication of a model from the printed templates in accordance with the printed instructions;

fabricating a model in response to the following of the above-listed method steps;

placing a template in the bending tool and bending the template for forming a crisp angle bend in the template in response to a user sliding his finger over the bending tool; and forming an aircraft wing structure having a first wing tube member having a right-triangular cross-section and a second wing tube member also having a right-triangular cross-section arranged in a back to back configuration wherein the first wing tube has a base wall, an upstanding leg wall and hypotenuse wall and the second wing tube has a base wall longer than the base wall of the first wing tube, an upstanding leg wall substantially the same length as the first wing tube and hypotenuse wall longer than the hypotenuse wall of the first wing tube and the wing tube members are adhered to each other at corresponding upstanding leg walls for forming an airfoil having a flat bottom surface and an angular top surface.

* * * * *